US007703279B2

(12) United States Patent
Engstrand

(10) Patent No.: US 7,703,279 B2
(45) Date of Patent: Apr. 27, 2010

(54) PROGRAMMABLE CYLINDER, SYSTEM AND METHOD FOR CHANGING VELOCITY OF A MACHINE ELEMENT WITHIN A CYLINDER

(75) Inventor: Bradley Engstrand, Hartford, WI (US)

(73) Assignee: Phaedrus, LLC, Hartford, WI (US)

( * ) Notice: Subject to any disclaimer, the term of this patent is extended or adjusted under 35 U.S.C. 154(b) by 162 days.

(21) Appl. No.: 11/455,321

(22) Filed: Jun. 19, 2006

(65) Prior Publication Data

US 2007/0289443 A1 Dec. 20, 2007

(51) Int. Cl.
*F01B 31/12* (2006.01)

(52) U.S. Cl. ..... 60/368; 92/5 R

(58) Field of Classification Search ..... 60/368, 60/534; 91/1; 92/5 R, 5 L
See application file for complete search history.

(56) References Cited

U.S. PATENT DOCUMENTS 4,661,695 A 4/1987 Mori et al.
4,806,707 A 2/1989 Landmeier
4,811,561 A * 3/1989 Edwards et al. ..... 60/368
4,902,903 A 2/1990 Segerson et al.
5,182,979 A 2/1993 Morgan
5,744,705 A 4/1998 Derouen et al.
6,952,009 B1 10/2005 Engstrand
2004/0089797 A1* 5/2004 Engstrand ..... 250/231.1

OTHER PUBLICATIONS

U.S. Appl. No. 11/412,152, filed Apr. 25, 2006, Engstrand.

* cited by examiner

*Primary Examiner*—F. Daniel Lopez
(74) *Attorney, Agent, or Firm*—Patents+TMS, P.C.

(57) ABSTRACT

A programmable cylinder, a system and a method change a velocity of a machine element within a compartment. A light detector within the compartment determines that the machine element is located at a first position or at a second position and/or is moving at a first velocity or at a second velocity. Switches determine that the machine element may be located at the first position or at the second position and/or is moving at the first velocity or at the second velocity. A microprocessor transmits a control signal to a transducer to alter an electrical current of the transducer to move valves of the compartment between an open position and a closed position. A compressed fluid within the interior of the compartment is changed via the valves. The machine element is accelerated and/or is decelerated to the first velocity or to the second velocity via the compressed fluid. A graphic user interface and/or a terminal accesses and controls the microprocessor and/or the transducer to move the machine element at the first velocity or at the second velocity within the compartment.

20 Claims, 2 Drawing Sheets

PROGRAMMABLE CYLINDER, SYSTEM AND METHOD FOR CHANGING VELOCITY OF A MACHINE ELEMENT WITHIN A CYLINDER

BACKGROUND OF THE INVENTION

The present invention generally relates to a programmable cylinder, a system and a method for changing a velocity of a machine element within a cylinder. More specifically, the present invention relates to a programmable cylinder, a system and a method for changing a velocity of a machine element within a cylinder which may provide a compartment to detect a first position and/or a second position of a machine element within a compartment. A light source may be located within and/or may be adjacent to an interior of the compartment for transmitting light into the interior of the compartment. A light detector may measure, may detect and/or may identify an intensity of the light within the interior of the compartment which may not have been absorbed, may have been diffused and/or may have been attenuated by a surface of the compartment and/or of the machine element to determine the first position and/or the second position of the machine element. In an embodiment, a switch may be connected to the compartment at the first position and/or at the second position of the machine element within the compartment. The switch may be activated by and/or may be deactivated by the machine element to identify that the machine element is located at the first position and/or the second position within the interior of the compartment.

A microprocessor may be in communication with the light detector and/or the switch to determine, to detect and/or to identify that the machine element is located at the first position and/or at the second position within the interior of the compartment. The microprocessor may transmit a signal to a transducer which may be connected to one or more valves of the programmable cylinder. The transducer may open and/or may close one or more valves connected to the programmable cylinder to increase and/or to decrease an amount of compressed fluid within the interior of the compartment. With the machine element at the first position and/or at the second position, the microprocessor may increase and/or may decrease an electrical current of the transducer for opening and/or for closing one or more valves of the programmable cylinder. As a result, the microprocessor, the transducer and/or the valves may decelerate and/or may accelerate movement of the machine element within the interior of the compartment via the compressed fluid. A terminal and/or a graphic user interface may be connected to the microprocessor for accessing, for operating and/or for controlling the microprocessor and/or the transducer to open and/or to close one or more valves of the programmable cylinder. As a result, a user may decelerate and/or may accelerate the movement of the machine element within the interior of the compartment at the first position and/or at the second position of the machine element.

It is, of course, generally known to provide a cylinder having a machine element within an interior of the cylinder. The machine element moves within the interior of the cylinder from a first end of the cylinder to a second end of the cylinder. Traditionally, a switch may be connected to the first end and to the second end of the cylinder to detect and/or to determine that the machine element is adjacent to the first end or to the second end of the cylinder. The machine element must physically abut or must physically contact the switch to mechanically activate and/or to mechanically deactivate the switch to identify that the machine element is adjacent to the first end or to the second end of the cylinder.

A control box is connected to the switch at the first end and at the second end of the cylinder to determine that the machine element is adjacent to the first end or to the second end of the cylinder. The control box may determine a velocity of movement of the machine element within the interior of the cylinder which corresponds to an amount of time which elapses for the machine element to move from the first end to the second end of the cylinder. The control box may transmit a signal to a solenoid switch for increasing and/or for decreasing the velocity of movement of the machine element within the cylinder. As a result, the control box may increase or may decrease the amount of time which elapses for the machine element to move from the first end to the second end of the cylinder. The control box and/or the solenoid switch may only determine to decrease or to increase the velocity of movement of the machine element via the machine element activation and/or deactivation of the switch at the first end or at the second end of the cylinder. As a result, the control box only increases or only decreases the velocity of movement of the machine element when the machine element is adjacent to the first end and/or to the second end of the cylinder.

The control box is incapable of determining whether to increase and/or to decrease the velocity of movement of the machine element at one or more positions between the first end and the second end of the cylinder. As a result, the velocity of movement of the machine element may not be increased and/or may not be decreased at one or more positions between the first end and the second end of the cylinder. Moreover, the physical contact of the machine element and the switches at the first end and/or the second end of the cylinder may damage and/or may destroy the machine element within the interior of the compartment. Damage to and/or destruction of the machine element may prevent the machine element from moving between the first end and the second end of the cylinder. As a result, the cylinder may be inoperable from the damage and/or from the destruction of the machine element which may be caused by the physical contact with the switch at the first end and/or at the second end of the cylinder.

A need, therefore, exists for a programmable cylinder, a system and a method for changing a velocity of a machine element within a cylinder. Additionally, a need exists for a programmable cylinder, a system and a method for changing a velocity of a machine element within a cylinder which may not damage and/or may not destroy a machine element within an interior of a programmable cylinder. Further, a need exists for a programmable cylinder, a system and a method for changing a velocity of a machine element within a cylinder which may detect one or more positions of a machine element within an interior of a programmable cylinder between a first end and a second end of the programmable cylinder.

Still further, a need exists for a programmable cylinder, a system and a method for changing a velocity of a machine element within a cylinder which may detect a position of a machine element within an interior of a programmable cylinder without physically contacting the machine element. Moreover, a need exists for a programmable cylinder, a system and a method for changing a velocity of a machine element within a cylinder which may accelerate and/or may decelerate a machine element at one or more positions between a first end and a second end of a programmable cylinder. Furthermore, a need exists for a programmable cylinder, a system and a method for changing a velocity of a machine element within a cylinder which may open and/or may close valves connected to a programmable cylinder to accelerate and/or to decelerate a machine element at one or more positions between a first end and a second end of the programmable cylinder.

SUMMARY OF THE INVENTION

The present invention provides a programmable cylinder, a system and a method for changing a velocity of a machine element within a cylinder. The system may provide a programmable cylinder which may have a machine element that moves between a first end and a second end within an interior of a compartment of the programmable cylinder. A light source and/or a light detector may be connected to the compartment of the programmable cylinder for detecting and/or for determining a first position and/or a second position of the machine element within the interior between the first end and the second end of the compartment. In an embodiment, a switch may be connected to the compartment to detect and/or to determine the first position or the second position of the machine element within the interior of the compartment. A microprocessor may be connected to the light detector and/or to the switch to identify and/or to determine that the machine element may be located in the first position and/or in the second position within the interior of the programmable element.

The microprocessor may transmit a signal to a transducer and/or to one or more valves which may be connected to the programmable element. The transducer may open and/or may close one or more valves which may be connected to the programmable cylinder when the machine element may be located at the first position and/or at the second position within the interior of the programmable cylinder. An amount of a compressed fluid may be increased and/or may be decreased within the interior of the compartment via the one or more valves of the programmable cylinder. The amount of the compressed fluid within the interior of the compartment may accelerate and/or may decelerate movements of the machine element within the interior of the compartment between the first end and the second end of the programmable cylinder. The microprocessor may transmit a signal to the transducer to accelerate and/or to decelerate the movements of the machine element via the one or more valves and/or the compressed fluid within the interior of the compartment. As a result, the microprocessor and/or the transducer may accelerate and/or may decelerate the movements of the machine element within the interior of the compartment at the first end and/or the second end of the compartment and at the first position and/or the second position of the machine element.

To this end, in an embodiment of the present invention, a cylinder for moving a machine element within the cylinder at a first velocity and at a second velocity which is different than the first velocity wherein the machine element has a first side and a second side located opposite to the first side wherein a shaft is attached to the second side of the machine element wherein the shaft moves the machine element within the cylinder is provided. The cylinder has a compartment having a length defined between a first end and a second end located opposite to the first end wherein the compartment has exterior walls defining an interior of the compartment wherein the shaft moves the machine element within the interior of the compartment between the first end and the second end of the compartment at the first velocity. Further, the cylinder has a light detector connected to the exterior walls of the compartment wherein the light detector is adjacent to the interior of the compartment wherein the light detector detects an intensity of light within the interior of the compartment wherein the intensity of the light corresponds to a first position of the machine element within the interior of the compartment wherein the light detector determines that the machine element is moving at the first velocity within the interior of the compartment. Moreover, the cylinder has a microprocessor electrically connected to the light detector wherein the microprocessor determines the first velocity of the machine element via the light detector wherein the microprocessor determines that the machine element is located at the first position within the interior of the compartment wherein the machine element is moved to a second position within the interior of the compartment at the second velocity via the microprocessor.

In an embodiment, the cylinder has a light emitter connected to the exterior walls of the compartment wherein the light emitter is adjacent to the interior of the compartment wherein the light emitter transmits the light within the interior of the compartment.

In an embodiment, the cylinder has a fluid located within the interior of the compartment wherein the fluid moves the machine element at the first velocity or at the second velocity within the interior of the compartment.

In an embodiment, the cylinder has a switch connected to the exterior walls of the compartment wherein the machine element moves the switch between an open position and a closed position wherein the switch determines that the machine element is located at the first position within the interior of the compartment.

In an embodiment, the cylinder has a seal connected to the exterior walls of the compartment wherein the seal is located between the light detector and the interior of the compartment.

In an embodiment, the cylinder has a surface formed on the exterior walls of the compartment and the first side of the machine element wherein the surface attenuates the light within the interior of the compartment.

In another embodiment of the present invention, a system for moving a machine element at a first velocity or at a second velocity wherein the machine element has a shaft which moves the machine element is provided. The system has a compartment having a length defined between a first end and a second end located opposite to the first end wherein the compartment has exterior walls defining an interior of the compartment wherein the machine element moves within the interior of the compartment between the first end and the second end of the compartment. Further, the system has a microprocessor connected to the compartment wherein the microprocessor identifies that the machine element is located at a first position within the interior of the compartment and that the machine element is moving at the first velocity wherein the second velocity is different than the first velocity. Still further, the system has a fluid located within the interior of the compartment wherein an amount of the fluid corresponds to the first velocity of the machine element. Moreover, the system has a valve connected to the compartment and the microprocessor wherein the valve is controlled by the microprocessor wherein the valve changes the amount of the fluid within the interior of the compartment wherein the machine element moves to a second position within the interior of the compartment at a second velocity wherein the amount of the fluid within the interior of the compartment corresponds to the second velocity of the machine element.

In an embodiment, the system has means for determining the first position of the machine element within the interior of the compartment wherein the means for determining the first position of the machine element is located within the interior of the compartment.

In an embodiment, the system has a transducer connected to the microprocessor and the valve wherein the transducer operates the valve.

In an embodiment, the system has means for emitting light within the interior of the compartment wherein the means for emitting light is located within the interior of the compartment.

In an embodiment, the system has a graphic user interface connected to the microprocessor wherein the graphic user interface controls the microprocessor wherein the machine element moves within the interior of the compartment at the first velocity or at the second velocity.

In an embodiment, the system has a data communication network connected to the microprocessor wherein the microprocessor is accessible via the data communication network.

In another embodiment of the present invention, a method for changing a velocity of a machine element within a cylinder wherein the machine element has a first side and a second side located opposite to the first side wherein a shaft is connected to the second side wherein the shaft moves the machine element within the cylinder is provided. The method has the step of providing a compartment having a length defined between a first end and a second end located opposite to the first end wherein the compartment has exterior walls defining an interior of the compartment wherein the shaft moves the machine element within the interior of the compartment between the first end and the second end of the compartment wherein a first amount of a fluid is located within the interior of the compartment wherein the first amount of the fluid corresponds to the first velocity of the machine element. Further, the method has the step of determining the first velocity of the machine element wherein the machine element is located at a first position within the interior of the compartment wherein the first position is adjacent to the first end. Moreover, the method has the step of moving the machine element from the first position to a second position within the interior of the compartment wherein the second position is located between the first position and the second end within the interior of the compartment wherein the machine element moves to the second position at the second velocity wherein a second amount of the fluid is located within the interior of the compartment wherein the second amount corresponds to the second velocity of the machine element.

In an embodiment, the method has the step of detecting an intensity of light within the interior of the compartment wherein the intensity of light within the interior of the compartment corresponds to the first position or the second position of the machine element within the interior of the compartment.

In an embodiment, the method has the step of connecting a valve to the compartment wherein the valve replaces the first amount of the fluid with the second amount of the fluid within the interior of the compartment.

In an embodiment, the method has the step of controlling the fluid within the interior of the compartment wherein the first amount of the fluid replaces the second amount of the fluid within the interior of the compartment.

In an embodiment, the method has the step of forming a surface on the first side of the machine element or the exterior walls of the compartment wherein the surface attenuates light within the interior of the compartment.

In an embodiment, the method has the step of emitting light into the interior of the compartment wherein the first position of the machine element is detectable via the light emitted within the interior of the compartment.

In an embodiment, the method has the step of moving the machine element from the second position to the first position within the interior of the compartment.

In an embodiment, the method has the step of identifying the second velocity of the machine element at the second position within the interior of the compartment.

It is, therefore, an advantage of the present invention to provide a programmable cylinder, a system and a method for changing a velocity of a machine element within a cylinder.

Another advantage of the present invention is to provide an a programmable cylinder, a system and a method for changing a velocity of a machine element within a cylinder which may detect and/or may determine a position of a machine element within an interior of a compartment between a first end and a second end of a programmable cylinder.

Yet another advantage of the present invention is to provide a programmable cylinder, a system and a method for changing a velocity of a machine element within a cylinder which may prevent damage and/or may prevent destruction to a machine element by reducing physical contact with the machine element.

A still further advantage of the present invention is to provide a programmable cylinder, a system and a method for changing a velocity of a machine element within a cylinder which may provide a light source and/or a light detector to determine a position of a machine element within an interior of a compartment between a first end and a second end of a programmable cylinder.

Another advantage of the present invention is to provide a programmable cylinder, a system and a method for changing a velocity of a machine element within a cylinder which may detect an intensity of light within an interior of a compartment to determine a position of a machine element within an interior of a compartment between a first end and a second end of a programmable cylinder.

A still further advantage of the present invention is to provide a programmable cylinder, a system and a method for changing a velocity of a machine element within a cylinder which may connect one or more switches to a programmable cylinder to determine a position of a machine element between a first end and a second end of the programmable cylinder.

Yet another advantage of the present invention is to provide a programmable cylinder, a system and a method for changing a velocity of a machine element within a cylinder which may provide a surface on a movable element and/or on an interior of a compartment for absorbing, for diffusing and/or for attenuating light emitted within the interior of a programmable cylinder.

Another advantage of the present invention is to provide a programmable cylinder, a system and a method for changing a velocity of a machine element within a cylinder which may accelerate and/or may decelerate a machine element at a position between a first end and a second end of the programmable cylinder.

And, another advantage of the present invention is to provide a programmable cylinder, a system and a method for changing a velocity of a machine element within a cylinder which may provide a microprocessor to accelerate and/or to decelerate a machine element at a position between a first end and a second end of a programmable element.

A still further advantage of the present invention is to provide a programmable cylinder, a system and a method for changing a velocity of a machine element within a cylinder which may open and/or may close one or more valves of a programmable cylinder to accelerate and/or to decelerate a machine element of the programmable cylinder at a position within an interior of compartment between a first end and a second end of the programmable element.

Yet another advantage of the present invention is to provide a programmable cylinder, a system and a method for changing a velocity of a machine element within a cylinder which may provide a compressed fluid to accelerate and/or to decelerate a machine element of a programmable cylinder at a position within an interior of a compartment between a first end and a second end of the programmable cylinder.

A still further advantage of the present invention is to provide a programmable cylinder, a system and a method for changing a velocity of a machine element within a cylinder which may provide a graphic user interface and/or a terminal to connect to a microprocessor and a transducer for accelerating and/or for decelerating a machine element of a programmable cylinder.

Another advantage of the present invention is to provide a programmable cylinder, a system and a method for changing a velocity of a machine element within a cylinder which provide a microprocessor to increase and/or to decrease an electrical current of a transducer for accelerating and/or for decelerating a machine element of the programmable cylinder.

A still further advantage of the present invention is to provide a programmable cylinder, a system and a method for changing a velocity of a machine element within a cylinder which may provide a network connectable to a microprocessor and/or to a remote terminal for transmitting a signal to a transducer for accelerating and/or for decelerating a machine element of a programmable cylinder.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention generally relates to a programmable cylinder, a system and a method for changing a velocity of a machine element within a cylinder. A programmable cylinder may have a compartment housing a machine element which may move within an interior of the compartment between a first end and a second end of the programmable cylinder. A light source and/or a light detector may be connected to and/or may be attached to the compartment of the programmable cylinder for determining one or more positions of the machine element within the interior of the compartment between the first end and the second end of the programmable cylinder. A surface may be formed on the machine element and/or on the compartment for absorbing, for diffusing and/or for attenuating light emitted into an interior of the compartment from the light source. The light detector may measure an intensity of light within the interior of the compartment to determine one or more positions of the machine element within the interior of the compartment between the first end and the second end of the programmable cylinder. In an embodiment, one or more switches may be attached to and/or may be connected to the programmable cylinder to determine one or more positions of the machine element within the interior of the compartment between the first end and the second end of the programmable cylinder.

A microprocessor may be in communication with the light detector and/or with one or more switches to identify and/or to determine one or more positions of the machine element within the interior of the compartment between the first end and the second end of the programmable cylinder. The microprocessor may transmit a signal to a transducer for opening and/or for closing valves connected to the programmable cylinder. As a result, the valves may increase and/or may decrease an amount of compressed fluids within the interior of the compartment of the programmable cylinder. The amount of compressed fluids within the interior of the compartment may increase and/or may decrease a velocity of movements of the machine element between the first end and the second end of the programmable cylinder. A graphic user interface (hereinafter "the GUI") and/or a terminal may be connected to and/or may be in communication with the microprocessor for transmitting the signal to the transducer to open and/or to close the valves of the programmable cylinder. As a result, a user may increase and/or may decrease the velocity of movements of the machine element via the GUI, the terminal, the microprocessor, the transducer and/or the valves.

Figure 1:
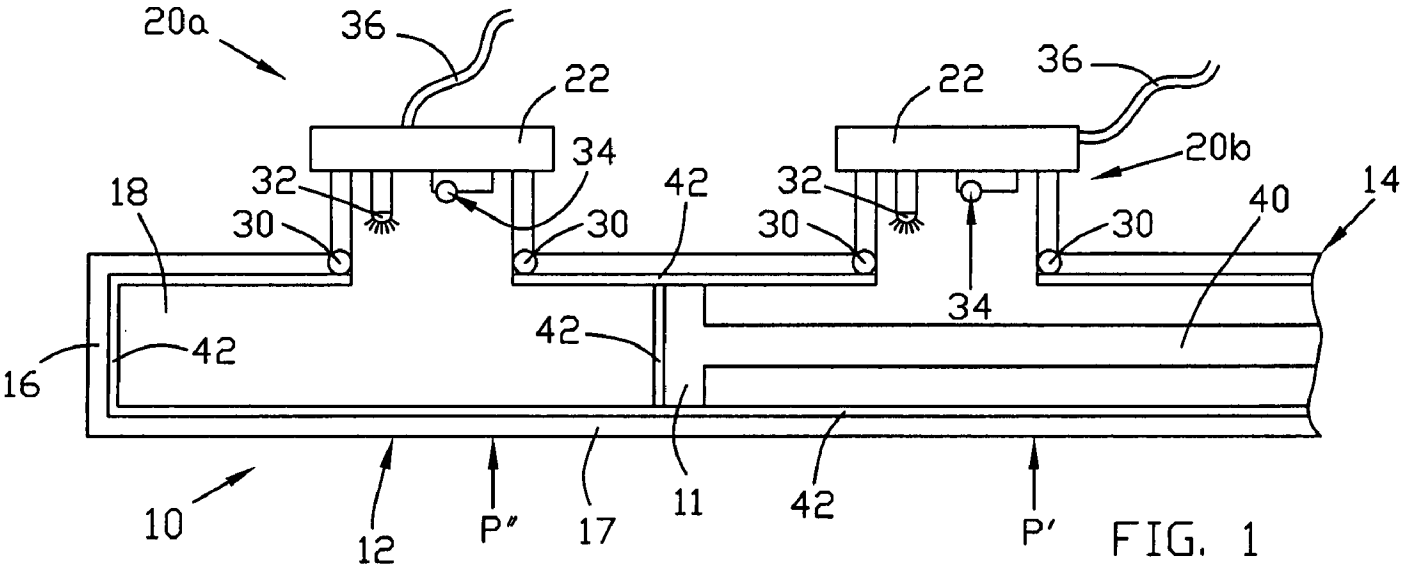
FIG. 1 illustrates a cross-sectional view of a programmable cylinder for moving a machine element within the programmable cylinder in an embodiment of the present invention.

Referring now to the drawings wherein like numerals refer to like parts, FIG. 1 illustrates a programmable cylinder 10 (hereinafter "the cylinder 10") in an embodiment of the present invention. The cylinder 10 may have a machine element 11 and a compartment 12 with a first end 14 and a second end 16 which may be located at a position opposite to the first end 14. The cylinder 10 may have exterior walls 17 which may be located between the first end 14 and the second end 16 of the cylinder 10. The first end 14, the second end 16 and the exterior walls 17 may define an interior 18 of the compartment 12. The machine element 11 may be located within and/or may be positioned within the interior 18 of the compartment 12. The machine element 11 may move and/or may transverse between the first end 14 and the second end 16 of the compartment 12.

Figure 3:
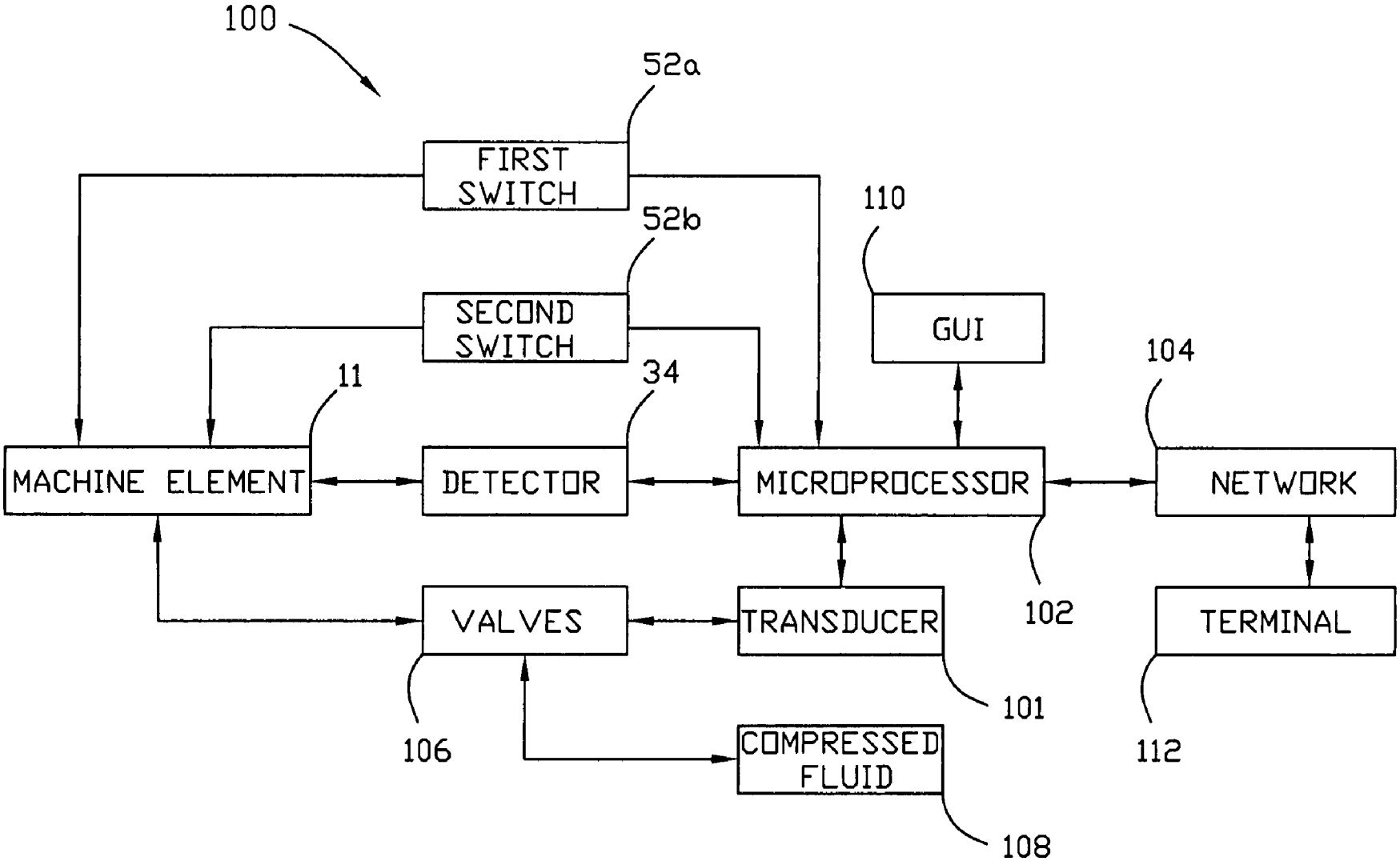
FIG. 3 illustrates a black box diagram of a system for moving a machine element within a cylinder in an embodiment of the present invention.

The cylinder 10 may be, for example, a hydraulic cylinder, a pneumatic cylinder, a gas cylinder and/or the like. A compressed fluid 108 (as shown in FIG. 3) may be located within the interior 18 of the compartment to move the machine element 11 within the interior 18 of the compartment 12 between the first end 14 and the second end 16 of the compartment 12. The compressed fluid 108 may be liquids, gas and/or the like.

A first light array 20*a* (hereinafter "the first array 20*a*") and/or a second light array 20*b* (hereinafter "the second array 20*b*") may have a base 22 and/or a seal 30 for mechanically attaching as shown in FIG. 1. The seal 30 may adhere and/or may secure the first array 20*a* and/or the second array 20*b* (hereinafter collectively known as "the arrays 20*a*, 20*b*") to the compartment 10. The arrays 20*a*, 20*b* may be located between and/or may be positioned between the first end 14 and the second end 16 of the compartment 12. The first array 20*a* may be located between and/or may be positioned between the second array 20*b* and the second end 16 of the compartment 12. The second array 20*b* may be located between and/or may be positioned between the first array 20*a* and the first end 14 of the compartment 12.

The seal 30 of the arrays 20*a*, 20*b* may be insertable into the exterior walls 17 for mechanically attaching the arrays 20*a*, 20*b* to the compartment 12 via a seal 30. A light source 32 and/or a light detector 34 (hereinafter "the detector 34") may be located on and/or may be position on the base 22 of the arrays 20*a*, 20*b*. The light source 32 and/or the detector 34 may be located between and/or may be positioned between the base 22 and the interior 18 of the compartment 12. As a result, the interior 18 of the compartment 12 may be accessible by the light source 32 and/or the detector 34 of the arrays 20*a*, 20*b*.

The seal 30 may connect the arrays 20*a*, 20*b* to the exterior walls 17 of the compartment 12 for sealing and/or for enclosing the interior 18 of the compartment 12 with the arrays 20*a*, 20*b*. The seal 30 may be located between and/or may be positioned between the exterior walls 16 of the compartment 12 and the base 22 of the arrays 20*a*, 20*b*. As a result, the arrays 20*a*, 20*b* may be attached to, may be connected to and/or may be secured to the compartment 10 via the seal 30. The seal 30 may be made from a material, such as, for example, rubber, polyethylene, polyurethane, plastic and/or the like. The present invention should not be deemed as limited to a specific embodiment of the material of the seal 30.

The light source 32 may transmit, may emit and/or may project light into the interior 18 of the compartment 12 to illuminate the interior 18 of the compartment 12. The light source 32 may be, for example, a light emitting diode, a halogen light, a fluorescent light, an incandescent light, a neon light and/or the like. The light emitted from the light source 32 may be continuous, uninterrupted and/or may be uniform within the interior 18 of the compartment 12. The present invention should not be deemed as limited to a specific embodiment of the light source 32. The detector 34 may detect, may measure, may sense, may identify and/or may determine an intensity of the light emitted from the light source 32 within the interior 18 of the compartment 12. The detector 34 may detect, may measure, may sense, may identify and/or may determine an intensity of the light emitted from the light emitter 32 within the interior 18 of the compartment 12. It should be understood that the light source 32 may be any light source capable of projecting, emitting and/or transmitting the light as known to one of ordinary skill in the art.

An electrical communication cable 36 (hereinafter "the cable 36") may be mechanically attached to and/or may be electrically connected to the base 22 of the arrays 20*a*, 20*b*. The cable 36 may be electrically connected to and/or may be mechanically attached to the light source 32 and/or the detector 34 via the base 22 of the arrays 20*a*, 20*b*. The light source 32 and/or the detector 34 may be electrically connected to and/or may be in communication with a microprocessor 102 (shown in FIG. 3) via the cable 36 and/or the base 22 of the arrays 20*a*, 20*b*. The microprocessor 102 may be programmed to operate, to activate and/or to deactivate the light source 32 and/or the detector 34. As a result, the light source 32 and/or the detector 34 may be operated by and/or may be controlled by the microprocessor 102. The microprocessor 102 may determine, may identify and/or may detect the intensity of the light within the interior 18 of the compartment 12.

Figure 2:
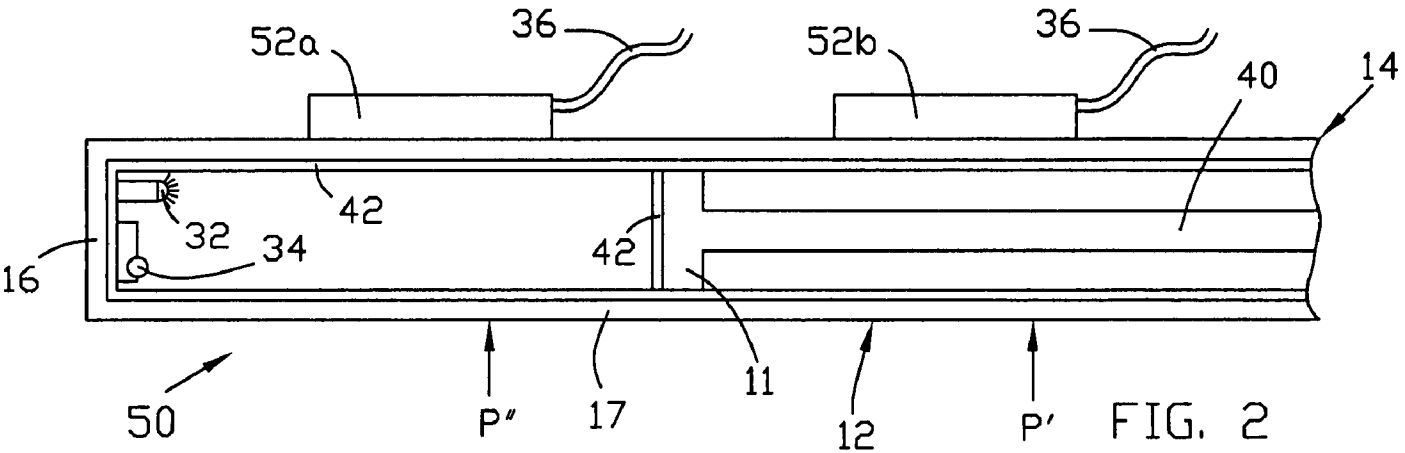
FIG. 2 illustrates a cross-sectional view of a programmable cylinder for moving a machine element within the programmable cylinder in an embodiment of the present invention.

The machine element 11 may have a shaft 40 which may extend from the machine element 11 inwardly with respect to the first end 14 of the compartment 10 as shown in FIGS. 1 and 2. The shaft 40 may move the machine element 11 between the first end 14 and the second end 16 of the compartment 12. The shaft may move the machine element 11 to a first position P' and/or to a second position P" within the interior 18 of the compartment 12. The first position P' and/or the second position P" may be located between the first end 14 and the second end 16 of the compartment 12. The first position P' of the machine element 11 may be adjacent to and/or may correspond to the second array 20*b*. The second position P" of the machine element 11 may be adjacent to and/or may correspond to the first array 20*a*.

A surface 42 may be physically formed on the compartment 12 and/or the machine element 11 which may be adjacent to the interior 18 of the compartment 12. The surface 42 may absorb, may diffuse and/or may attenuate an amount of the light emitted within the interior 18 of the compartment 12 from the light source 32 of the arrays 20*a*, 20*b*. The surface 42 may be, for example, a coating, a finish, a texture, a light absorbing substance and/or the like. The surface 42 may be uniform, may be symmetric and/or may be continuous with respect to the interior 18 of the compartment 12 for absorbing, for diffusing and/or for attenuating the amount of the light emitted from the light source 32 of the arrays 20*a*, 20*b*. In an embodiment, the surface 42 of the machine element 11 and/or of the compartment 12 may be made from a first light absorbing material and/or a second light absorbing material, respectively. As a result, the surface 12 may absorb, may diffuse and/or may attenuate the light within the interior 18 of the compartment 12.

In an embodiment, the surface 42 may be, for example, a nitrile compound and/or a ceramic compound which may have light absorbing properties and/or light absorbing characteristics. The surface 42 of the compartment 12 and/or the machine element 11 may have various colors which may affect and/or may control the amount of the light which may be absorbed, may be diffused and/or may be attenuate within the interior 18 of the compartment 12. The surface 42 may absorb, may diffuse and/or may attenuate the amount of the light emitted within the interior 18 of the compartment 12. The amount of the light which may be absorbed, may be diffused and/or may be attenuated may indicative of the machine element 11 being located at the first position P' or at the second position P" within the interior 18 of the compartment 12.

In an embodiment, the surface 42 may be formed by sanding and/or by blasting the machine element 11 and/or the compartment 12 with a coarse surface (not shown in the figures), such as, for example, a sand paper. The coarse material may roughen, may scratch and/or may damage the machine element 11 and/or the compartment 12 to form the surface 42 on the machine element 11 and/or the compartment 12, respectively. The surface 42 of the machine element 11 and/or the compartment 12 may have, for example, the light absorbing properties, light diffusing properties and/or light attenuating properties. As a result, the surface 42 of the machine element 11 and/or the compartment 12 may absorb the amount of the light emitted within the interior 18 of the compartment 12 from the light source 32 of the arrays 20*a*, 20*b*.

The light within the interior 18 of the compartment 12 which may not have been absorbed by, may have been diffused by and/or may have been attenuated by the surface 42 of the compartment 12 and/or of the machine element 11 may illuminate the interior 18 of the compartment 12. As a result, the intensity of light within the interior 18 of the compartment 12 may correspond to an amount of the light which may not be absorbed by, may be diffused by and/or may be attenuated by the surface 42 of the machine element 11 and/or of the compartment 12. The intensity of the light within the interior 18 of the compartment 12 may correspond to and/or may be based on the first position P' and/or on the second position P" of the machine element 11 within the interior 18 of the compartment 12. The light detector 32 of the arrays 20*a*, 20*b* may measure and/or may determine the intensity of light within the interior 18 of the compartment 12 which may not be absorbed by, may be diffused by and/or may be attenuated by the surface 42 of the machine element 11 and/or the compartment 12. As a result, the light detector 32 of the arrays 20*a*, 20*b* may determine that the machine element 11 may be at the first position P' and/or at the second position P" based on the intensity of the light within the interior 18 of the compartment 18.

FIG. 2 illustrates a programmable cylinder 50 (hereinafter "the cylinder 50") in an embodiment of the present invention. The cylinder 50 may have the compartment 10 and the machine element 11 which may move between the first end 14 and the second end 16 of the compartment 12 via the shaft 40. The shaft 40 may move the machine element 11 to the first position P' and/or to the second position P" between the first end 14 and the second end 16 within the interior 18 of the compartment 12. The light source 32 and/or the detector 34 may be located at and/or may be positioned at the second end 16 of the compartment 12. Further, the light source 32 and/or the detector 34 may be located within and/or may be positioned within the interior 18 of the compartment 12. As a result, the light source 32 and/or the detector 34 may be located between and/or may be positioned between the machine element 11 and the second end 16 of the compartment 12.

The light source 32 of the cylinder 50 may emit, may transmit and/or may project the light into the interior 18 of the compartment 12 of the cylinder 50. The surface 42 of the machine element 11 and/or of the compartment 12 of the cylinder 50 may absorb, may diffuse and/or may attenuate the light emitted within the interior 18 of the compartment 12 by the light source 32. The light source 32 and/or the detector 34 of the cylinder 50 may be electronically connected to, may be mechanically attached to and/or may be in communication with the microprocessor 102 (shown in FIG. 3).

The light detector 32 of the cylinder 50 may measure and/or may determine the intensity of the light within the interior 18 of the compartment 12 which may not be absorbed by, may be diffused by and/or may be attenuated by the surface 42 of the cylinder 50. The amount of the light which may be absorbed by, may be diffused by and/or may be attenuated by the surface 42 of the cylinder 50 may correspond to and/or may be based on the first position P' of and/or the second position P" of the machine element 11 of the cylinder 50. The detector 34 of the cylinder 50 may determine that the machine element 11 may be located at the first position P' and/or at the second position P" within the interior 18 of the compartment 12.

In an embodiment, the cylinder 50 may have a first switch 52*a* and/or a second switch 52*b* (hereinafter collectively known as "the switches 52*a*, 52*b*") which may be attached to the exterior walls 17 of the compartment 12 as shown in FIG. 2. The first switch 52*a* may be adjacent to the first position P' of the machine element 11 within the interior 18 of the cylinder 50. The second switch 52*b* may be adjacent to the second position P" of the machine element 11 within the interior 18 of the cylinder 50. The switches 52*a*, 52*b* may be electrically connected to, may be mechanically attached to and/or may be in communication with the microprocessor 102 via the cable 36 to operate, to activate and/or to deactivate the switches 52*a*, 52*b*.

When the switches 52*a*, 52*b* may be activated by the microprocessor 102, the switches 52*a*, 52*b* may be in an open position or in a closed position. The switches 52*a*, 52*b* may have magnetic properties which may move the switches 52*a*, 52*b* between the open position and the closed position. As a result, the switches 52*a*, 52*b* may detect, may measure and/or may determine a magnetic field adjacent to and/or associated with the switches 52*a*, 52*b* for moving the switches 52*a*, 52*b* between the open position and the closed position. The switches 52*a*, 52*b* may be a magnetic switch, a Hall effect switch, a reed switch and/or the like. The microprocessor 102 may be programmed to determine that the switches 52*a*, 52*b* may have moved between the open position and the closed position. It should be understood that the switches 52*a*, 52*b* may be any switches which open and close by a magnetic field as known to one of ordinary skill in the art.

The machine element 11 may move to the first position P' within the interior 18 of the cylinder 50 via the shaft 40. As a result, the machine element 11 may be adjacent to the second switch 52*b*. The machine element 11 may change the magnetic field of the second switch 52*b* to move the second switch 52*b* between the open position and the closed position. The second switch 52*b* and/or the microprocessor 102 may detect and/or may determine that the machine element 11 may be located at the first position P' when the second switch 52*b* moves between the open position and the closed position.

The shaft 40 may move the machine element 11 to the second position P" within the interior 18 of the compartment 12 which may be adjacent to the first switch 52*a*. The machine element 11 may change the magnetic field of the first switch 52*a* to move the first switch 52*a* between the open position and the closed position. The first switch 52*a* and/or the microprocessor 102 may detect and/or may determine that the machine element 11 may be located at the second position P" when the first switch 52*a* moves between the open position and the closed position. As a result, the microprocessor 102 may identify and may determine that the machine element 11 may be located at the first position P' and/or at the second position P" within the interior 18 of the cylinder 50 via the switches 52*a*, 52*b*.

The shaft 40 may be connected to the microprocessor 102 for moving the machine element 11 within the interior 18 of the cylinder 10 and/or of the cylinder 50 (hereinafter collectively known as "the cylinders 10, 50"). The microprocessor 102 may be programmed to operate and/or to move the shaft 40 and/or the machine element 11 between the first end 14 and the second end 16 of the cylinder 10, 50 at a first velocity or at a second velocity. The shaft 40 may move the machine element 11 at the first velocity or at the second velocity between the first end 14 and the second end 16 of the cylinders 10, 50. Further, the shaft 40 and/or the microprocessor 102 may move the machine element 11 at the first velocity and/or at the second velocity between the first position P' and the second P" within the interior 18 of the cylinders 10, 50.

The microprocessor 102 may be programmed to accelerate and/or to decelerate the machine element 11 between the first velocity and the second velocity within the interior 18 of the cylinders 10, 50. In an embodiment, the microprocessor 102 may move the machine element 11 at the first velocity between the first end 14 and the first position P' within the interior 18 of the cylinders 10, 50. The microprocessor 102 may accelerate and/or may decelerate the machine element 11 from the first velocity to the second velocity at the first position P' of the cylinder 10, 50. As a result, the machine element 11 may move from the first position P' to the second end 16 within the interior 18 of the cylinders 10, 50 at the second velocity. In an embodiment, the microprocessor 102 may accelerate or may decelerate the machine element 11 from the second velocity to the first velocity at the second position P" within the interior 18 of the cylinders 10, 50. As a result, the machine element 11 may move from the second position P" to the second end 16 of the cylinders 10, 50 at the first velocity.

FIG. 3 illustrates a system 100 which may have the detector 34 and/or the switches 52*a*, 52*b* in communication with and/or electrically connectable to the microprocessor 102. The detector 34 of the cylinders 10, 50 may determine and/or may identify that the machine element 11 may be located at the first position P' and/or at the second position P" within the interior 18 of the cylinders 10, 50. Further, the switches 52*a*, 52*b* of the cylinder 50 may determine and/or may identify that the machine element 11 may be located at the first position P' and/or at the second position P" within the interior 18 of the cylinder 50. The detector 34 and/or the switches 52*a*, 52*b* of the cylinders 10, 50 may transmit an output signal to the microprocessor 102 which may be indicative of the first position P' and/or of the second position P" within the interior 18 of the cylinders 10, 50. As a result, the microprocessor 102 may determine and/or may identify that the machine element 11 may be located at the first position P' and/or at the second position P" within the interior 18 of the cylinders 10, 50 via the output signal. Further, the microprocessor 102 may determine and/or may identify that the machine element 11 may be moved at the first velocity or at the second velocity within the interior 18 of the cylinders 10, 50 via the output signal.

The microprocessor 102 may be local with respect to or may be located remotely with respect to the cylinders 10, 50. The microprocessor 102 may be electrically connected to and/or may be in communication with the light source 32, the detector 34 and/or the switches 52*a*, 52*b* of the cylinders 10, 50 via the cable 36. The microprocessor 102 may instruct and/or may control the shaft 40 to move the machine element 11 between the first end 14 and the second end 16 of the cylinders 10, 50 at the first velocity or at the second velocity. Additionally, the microprocessor 102 may instruct and/or may control the shaft 40 for moving the machine element 11 to the first position P' and/or to the second position P" of the cylinders 10, 50 at the first velocity or at the second velocity.

The compressed fluid 108 may be injected into and/or may be removed from the interior 18 of the cylinders 10, 50 via valves 106 which may be connected to and/or may be attached to the cylinders 10, 50 as shown in FIG. 3. A transducer 101 may be mechanically attached to and/or may be electrical connected to the valves 106 for controlling and/or for operating the valves 106. The transducer 101 may be, for example, an electro-mechanical solenoid, a solenoid switch, an electrical switch, a pneumatic solenoid valve, a hydraulic solenoid valve and/or the like. The present invention should not be deemed as limited to a specific embodiment of the transducer 101.

The interior 18 of the cylinders 10, 50 may contain and/or may store the compressed fluid 108 for moving the machine element 11 between the first end 14 and the second end 16 within the interior 18 of the cylinders 10, 50. An amount of the compressed fluid 108 within the interior 18 of the cylinders 10, 50 may move the machine element 11 within the interior 18 at the first velocity or at the second velocity. The amount of the compressed fluid 108 within the interior 18 of the cylinders 10, 50 may correspond to and/or may be based on the first velocity and/or the second velocity of the machine element 11 moving within the interior 18 of the cylinders 10, 50.

The microprocessor 102 may be electrically connected to and/or may be in communication with the transducer 101. The microprocessor 102 may transmit a control signal to the transducer 101 to move the valves between an open position and a closed position for increasing and/or for decreasing the amount of the compressed fluid 108 within the interior of the cylinder 10, 50. An electrical current may be associated with the transducer 101 of the cylinders 10, 50 for moving the valves 106 between the open position and the closed position. The microprocessor 102 may be programmed to transmit the control signal to the transducer 101 to move the valves 106 from the closed position to the open position. The microprocessor 102 may be programmed to transmit the control signal to the transducer 101 to increase and/or to decrease the electrical current of the transducer 101 via the control signal.

The control signal may increase and/or may decrease the current of the transducer 101 for moving the valves 106 to the open position and/or to the closed position. As a result, the transducer 101 may move the valves 106 to the open position and/or to the closed position by increasing and/or by decreasing the electrical current of the transducer 101 via the control signal from the microprocessor 102. The microprocessor 102 may increase and/or may decrease the amount of the compressed fluid 108 within the interior 18 of the cylinders 10, 50 by increasing and/or decreasing the electrical current of the transducer 101. As a result, the microprocessor may accelerate and/or may decelerate the machine element 11 of the cylinders 10, 50 to the first velocity and/or to the second velocity at the first position P' or at the second position P" via the valves 106, the transducer 101 and/or the compressed fluid 108.

A graphic user interface 110 (hereinafter "the GUI 110") may be electrically connected to, may be mechanically attached to and/or may be in communication with the microprocessor 102 of the system 100 as shown in FIG. 3. The GUI 110 may be locally with respect to the microprocessor 102 for accessing the microprocessor 102 to transmit the control signal to the transducer 101. The user may access, may control, may operate and/or may program the microprocessor 102 via the GUI 110. A user (not shown in the figures) may increase and/or may decrease the electrical current of the transducer 101 by transmitting the control signal to the transducer 101 from the microprocessor 101 via the GUI 110.

The user may increase the amount of the compressed fluid 108 within the interior 18 of the cylinders 10, 50 via the GUI 110, the microprocessor 102, the transducer 101 and/or the compressed fluid 108. As a result, the user may accelerate or may decelerate the machine element 11 of the cylinders 10, 50 to the first velocity and/or to the second velocity via the GUI 110, the microprocessor 102, the transducer 101, the valves 106 and/or the compressed fluid 108. In an embodiment, the user may accelerate or may decelerate the machine element 11 of the cylinders 10, 50 to the first velocity and/or to the second velocity via the GUI 110, the transducer 101, the valves 106, the microprocessor 102 and/or the shaft 40.

In an embodiment, a terminal 112 may be electrically connected to and/or may be in communication with the microprocessor 102 via a data communication network 104 (hereinafter "the network 104"). The terminal 112 may access, may control and/or may operate the microprocessor 102 via the network 104. The terminal 112 may be located remotely with respect to or may be local with respect to the microprocessor 102. The terminal 112 may be, for example, a computer terminal, a mobile device and/or the like. In an embodiment, the mobile device may be, for example, a 4G mobile device, a 3G mobile device, an internet protocol (hereinafter "IP") cellular telephone, an ALL-IP electronic device, a PDA, a laptop computer and/or the like. It should be understood that the terminal 104 may be any terminal capable of accessing and/or of communicating with the microprocessor 102 via the network 104 as known to one having ordinary skill in the art.

The network 104 may be a fixed network, such as, for example, a cabled network, a permanent network and/or the like. The network 104 may be a temporary network, such as, for example, a modem network, a null modem network and/or the like. The network 104 may be, for example, a local area network, a metropolitan area network, a wide area network, a personal area network and/or the like. Alternatively, the network 104 may be a wireless network, such as, for example, a wireless metropolitan area network, a wireless local area network, a wireless personal area network, a global standard network, a personal communication system network, a pager-based service network, a general packet radio service, a universal mobile telephone service network, a radio access network and/or the like. The present invention should not be limited to a specific embodiment of the network 104. It should be understood that the network 104 may be any network capable of connecting the terminal 112 and the microprocessor 102 as known to one having ordinary skill in the art.

The user may access, may program, may control, may operate and/or may program the microprocessor 102 via the terminal 112 and/or the network 104. The user may control the microprocessor 102 to transmit the control signal to the transducer 101 via the terminal 112. The control signal may increase or may decrease the electrical current of the transducer 101 of the cylinders 10, 50 via the terminal 112, the network 104, the transducer 101 and/or the microprocessor 102. The user may control the transducer 101 to move the valves 106 of the cylinders 10, 50 to the open position and/or to the closed position via the terminal 112, the network 104 and/or the microprocessor 102. The user may increase and/or may decrease the amount of the compressed fluid 108 within the interior 18 of the cylinders 10, 50 via the terminal 112, the network 104, the microprocessor 102, the transducer 101 and/or the valves 106. The user may accelerate and/or may decelerate the machine element 11 of the cylinders 10, 50 to the first velocity and/or to the second velocity via the terminal 112, the network 104, the microprocessor 102, the compressed fluid 108, the transducer 101 and/or the valves 106.

In an embodiment, the machine element 11 may move from the first end 14 of the cylinders 10, 50 to the first position P' at the first velocity via the shaft 40. The detector 34 of the second array 20*b* may determine that the machine element 11 of the cylinder 10 may be located at the first position P' and/or may be moving at the first velocity. In an embodiment, the detector 34 and/or the second switch 52*b* of the cylinder 50 may determine that the machine element 11 may be located at the first position P' and may be moving at the first velocity. The microprocessor 102 may determine that the machine element 11 may be located at the first position P' and may be moving at the first velocity. The microprocessor 102 may be programmed to transmit the control signal to the transducer 101 for increasing and/or for decreasing the electrical current of the transducer 101 to open and/or to close the valves 106 of the cylinder 10, 50. As a result, the valves 106 of the cylinder 10, 50 may be opened and/or may be closed by the transducer 101.

The amount of the compressed fluid 108 within the interior 18 of the cylinders 10, 50 may be increased and/or may be decreased via the valves 106. The compressed fluid 108 and/or the shaft 40 may accelerate and/or may decelerate the machine element 11 of the cylinders 10, 50 to the second velocity. The machine element 11 may move from the first position P' to the second position P" within the interior 18 of the cylinders 10, 50.

The detector 32 of the first array 20*a* may determine that the machine element 11 of the cylinder 10 may be located at the second position P" and/or may be moving at the second velocity. In an embodiment, the detector 32 and/or the first switch 52*a* may determine that the machine element 11 of the cylinder 50 may be located at the second position P" and/or may be moving at the second velocity. The microprocessor 102 may determine the that machine element 11 may be located at the second position P" and may be moving at the second velocity. The microprocessor 102 may be programmed to maintain the machine element 11 at the second velocity as the machine element 11 moves between the second position P" and the second end 16 of the cylinders 10, 60. The machine element 11 of the cylinders 10, 50 may move between the second end 16 and the first end 14 of the compartment 10 at the second velocity.

In an embodiment, the microprocessor 102 may programmed to transmit the control signal to the transducer 101 for increasing and/or for decreasing the electrical current of the transducer 101. As a result, the valves 106 of the cylinder 10, 50 may open and/or may close via the transducer 101 and/or the control signal transmitted from the microprocessor 102. The amount of the compressed fluid 108 within the interior 108 of the cylinders 10, 50 may increase and/or may decrease via the valves 106. The shaft 40 and/or the compressed air 108 may accelerate and/or may decelerate the machine element 11 of the cylinders 10, 50 from the second velocity to the first velocity. The machine element 11 may move between the second position P" and the second end 16 of the cylinders 10, 50 at the first velocity. In an embodiment, the machine element 11 may move between the second end 16 and the first end 14 at the first velocity.

The machine element 11 of the cylinders 10, 50 may move within the interior 18 of the compartment 12 between the first end 14 and the second end 16 of the cylinders 10, 50. The light detector 34 may be mechanically connected to the compartment 12 for determining that the machine element 11 may be located at the first position P' and/or the second position P" and/or moving at the first velocity or at the second velocity. The light detector 34 may measure an intensity of light within the interior 18 of the compartment 10 to determine that the machine element 11 may be located at the first position P' and/or at the second position P". The switches 52*a*, 52*b* may determine that the machine element 11 may be located at the first position P' and/or at the second position P" and/or may be moving at the first velocity or at the second velocity.

The microprocessor 102 may transmit the control signal to the transducer 101 to increase and/or to decrease the electrical current of the transducer to move the valves 106 between the open position and the closed position. The amount of the compressed fluid 108 within the interior 18 of the cylinders 10, 50 may increase and/or may decrease via the valves 106. The machine element 11 may be accelerated and/or may be decelerated to the first velocity or to the second velocity between the first position P' and the second position P" via the compressed fluid 108 and/or the shaft 40. The user may access, may operate and/or may control the microprocessor 102 and/or the transducer 101 to move the machine element 11 at the first velocity or at the second velocity within the interior 18 of the cylinders 10, 50 via the GUI 110 and/or the terminal 112. As a result, the machine element 11 may move between and/or may transpose between the first end 14 and the second end 16 of the cylinders 10, 50 at the first velocity and/or at the second velocity.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A cylinder for moving a machine element within the cylinder at a first velocity and at a second velocity which is different than the first velocity wherein the machine element has a first side and a second side located opposite to the first side wherein a shaft is attached to the second side of the machine element wherein the shaft moves the machine element within the cylinder, the cylinder comprising:

a compartment having a length defined between a first end wall and a second end wall wherein the compartment has a first side wall and a second side wall that connect the first end wall to the second end wall wherein the first side wall and the second side wall are located between the first end wall and the second end wall of the compartment and further wherein the first side wall is located at a distance from the second side wall wherein the first side wall and the second side wall have a first length and the first end wall and the second end wall have a second length wherein the first length is greater than the second length wherein the first end wall, the second end wall, the first side wall and the second side wall define an interior of the compartment wherein the shaft moves the machine element within the interior of the compartment between the first end wall and the second end wall of the compartment at the first velocity;

a first light detector adjacent to the interior of the compartment wherein the first light detector detects a first intensity of light within the interior of the compartment wherein the first intensity of the light corresponds to a position of the machine element within the interior of the compartment wherein the first light detector is located at a distance from the first end wall of the compartment;

a first base that connects the first light detector to the first side wall wherein the base is located at a distance from the second side wall and further wherein the distance from the first base to the second side wall is greater than the distance from the first side wall to the second side wall and further wherein the distance from the first light detector to the second side wall is greater than the distance from the first side wall to the second side wall;

a second light detector adjacent to the interior of the compartment wherein the second light detector is located at a distance from the first end wall of the compartment wherein the distance of the first light detector from the first end wall is different than the distance of the second light detector from the first end wall wherein the second light detector detects a second intensity of light within the interior of the compartment wherein the second intensity of the light corresponds to the position of the machine element within the interior of the compartment;

a second base that connects the second light detector to the first side wall wherein the second base is located at a distance from the second side wall and further wherein the distance from the second base to the second side wall is greater than the distance from the first side wall to the second side wall and further wherein the distance from the second light detector to the second side wall is greater than the distance from the first side wall to the second side wall; and a microprocessor electrically connected to the first light detector and the second light detector wherein the microprocessor determines the first velocity of the machine element via the first light detector and the second light detector wherein the first velocity is determined based on the first intensity of light and the second intensity of light.

2. The cylinder of claim 1 further comprising:

a light emitter connected to the compartment wherein the light emitter is adjacent to the interior of the compartment wherein the light emitter transmits the light within the interior of the compartment.

3. The cylinder of claim 1 further comprising:

a fluid located within the interior of the compartment wherein an amount of the fluid corresponds to the first velocity or the second velocity of the machine element within the interior of the compartment.

4. The cylinder of claim 1 further comprising:

a compressed gas located within the interior of the compartment wherein an amount of the compressed gas corresponds to the first velocity or the second velocity of the machine element within the interior of the compartment.

5. The cylinder of claim 1 further comprising:

a seal connected to the compartment wherein the seal is located between the first light detector and the interior of the compartment.

6. The cylinder of claim 1 further comprising:

a surface formed on the first side of the machine element wherein the surface attenuates the light within the interior of the compartment.

7. A system for moving a machine element at a first velocity or at a second velocity wherein the second velocity is different than the first velocity, the system comprising:

a compartment having a length defined between a first wall and a second wall located opposite to the first wall wherein the compartment has a third wall and a fourth wall that connect the first wall to the second wall and further wherein the third wall is located at a distance from the fourth wall wherein the first wall, the second wall, the third wall and the fourth wall define an interior of the compartment wherein the machine element moves within the interior of the compartment between the first wall and the second wall;

a first light detecting means adjacent to the interior of the compartment wherein the first light detecting means is located at a distance from the first wall and further wherein the first light detecting means is located between the first wall and the second wall wherein the first light detecting means detects a first intensity of light within the interior of the compartment wherein the intensity of the light corresponds to a position of the machine element within the interior of the compartment wherein the first light detecting means is located at a distance from the fourth wall and further wherein the distance from the first light detecting means to the fourth wall is greater than the distance from the third wall to the fourth wall;

a second light detecting means adjacent to the interior of the compartment wherein the second light detecting means is located at a distance from the first wall wherein the distance of the first light detecting means from the first wall is different than the distance of the second light detecting means from the first wall and further wherein the second light detecting means is located between the first wall of the compartment and the second wall of the compartment wherein the second light detecting means detects a second intensity of light within the interior of the compartment wherein the second intensity of the light corresponds to the position of the machine element within the interior of the compartment wherein the second light detecting means is located at a distance from the fourth wall and further wherein the distance from the second light detecting means to the fourth wall is greater than the distance from the third wall to the fourth wall;

a microprocessor connected to the compartment wherein the microprocessor identifies that the machine element is located at the position within the interior of the compartment and that the machine element is moving at the first velocity;

a fluid located within the interior of the compartment wherein an amount of the fluid corresponds to the first velocity of the machine element; and a valve connected to the compartment and the microprocessor wherein the valve is controlled by the microprocessor wherein the valve changes the amount of the fluid within the interior of the compartment wherein the machine element moves to a second position within the interior of the compartment at the second velocity wherein the amount of the fluid within the interior of the compartment corresponds to the second velocity of the machine element.

8. The system of claim 7 further comprising:

a first light emitting means connected to the compartment wherein the first light emitting means is adjacent to the first light detecting means and further wherein the first light emitting means is located between the first wall and the second wall; and a second light emitting means connected to the compartment wherein the second light emitting means is adjacent to the second light detecting means and further wherein the second light emitting means is located between the first wall and the second wall wherein the first light emitting means and the second light emitting means transmit the light within the interior of the compartment.

9. The system of claim 7 further comprising:

a transducer connected to the microprocessor and the valve wherein the transducer operates the valve.

10. The system of claim 7 further comprising:

means for emitting light within the interior of the compartment wherein the means for emitting light is located within the interior of the compartment and further wherein the means for emitting light is located between the first end wall and the second end wall.

11. The system of claim 7 further comprising:

a graphic user interface connected to the microprocessor wherein the graphic user interface controls the microprocessor wherein the machine element moves within the interior of the compartment at the first velocity or at the second velocity.

12. The system of claim 7 further comprising:

a data communication network connected to the microprocessor wherein the microprocessor is accessible by a mobile device via the data communication network.

13. A method for changing a velocity of a machine element within a cylinder wherein the machine element has a first side and a second side located opposite to the first side wherein a shaft is connected to the second side wherein the machine element moves at a first velocity or at a second velocity wherein the second velocity is different than the first velocity, the method comprising the steps of:

providing a compartment having a length defined between a first end and a second end located opposite to the first end wherein the compartment has a first wall located at the first end of the compartment, a second wall located at the second end of the compartment, a third wall and a fourth wall that connect the first wall to the second wall and further wherein the third wall is located at a distance from the fourth wall wherein the first wall, the second wall, the third wall and the fourth wall define an interior of the compartment wherein the shaft moves the machine element within the interior of the compartment between the first end and the second end of the compartment wherein a first amount of a fluid is located within the interior of the compartment wherein the first amount of the fluid corresponds to the first velocity of the machine element wherein the compartment has a first point within the interior of the compartment and a second point within the interior of the compartment and further wherein the first point is a different distance from the first end of the compartment than the second point;

emitting light into the interior of the compartment from a first light emitting means and a second light emitting means wherein the first light emitting means is adjacent to the first point and the second light emitting means is adjacent to the second point and further wherein the first light emitting means and the second light emitting means are located on the third wall wherein the first light emitting means is located at a distance from the fourth wall wherein the distance from the first light emitting means to the fourth wall is greater than the distance from the third wall to the fourth wall;

detecting an intensity of light at the first point and an intensity of light at the second point wherein the intensity of light at the first point and the intensity of light at the second point indicate a position of the machine element within the interior of the compartment;

determining the first velocity of the machine element wherein the first velocity is determined based on the intensity of light at the first point and the intensity of light at the second point; and moving the machine element at a second velocity wherein a second amount of the fluid is located within the interior of the compartment wherein the second amount of the fluid corresponds to the second velocity of the machine element.

14. The method of claim 13 further comprising the step of:

forming a surface on the side walls of the compartment wherein the surface attenuates light within the interior of the compartment.

15. The method of claim 13 further comprising the step of:

connecting a valve to the compartment wherein the valve replaces the first amount of the fluid with the second amount of the fluid within the interior of the compartment.

16. The method of claim 13 further comprising the step of:

controlling the fluid within the interior of the compartment wherein the first amount of the fluid replaces the second amount of the fluid within the interior of the compartment.

17. The method of claim 13 further comprising the step of:

forming a surface on the first side of the machine element wherein the surface attenuates light within the interior of the compartment.

18. The method of claim 13 wherein the second light emitting means is located at a distance from the fourth wall wherein the distance from the second light emitting means to the fourth wall is greater than the distance from the third wall to the fourth wall.

19. The method of claim 13 further comprising the step of:

moving the machine element from the second position to the first position within the interior of the compartment.

20. The method of claim 13 further comprising the step of:

identifying the second velocity of the machine element at the second position within the interior of the compartment.

* * * * *